US008312565B1

(12) United States Patent
Alperin

(10) Patent No.: US 8,312,565 B1
(45) Date of Patent: Nov. 20, 2012

(54) BABY SLEEP AND COMFORT AID

(76) Inventor: Mindy Alperin, New York, NY (US)

( * ) Notice: Subject to any disclaimer, the term of this patent is extended or adjusted under 35 U.S.C. 154(b) by 0 days.

(21) Appl. No.: 13/426,981

(22) Filed: Mar. 22, 2012

(51) Int. Cl.
*A41B 13/08* (2006.01)
*A41B 13/10* (2006.01)
*A41B 13/00* (2006.01)

(52) U.S. Cl. ..... 2/49.1; 2/49.5; 2/75; 2/80; 2/83

(58) Field of Classification Search ..... 2/49.1–49.5, 2/69, 69.5, 71, 75, 79, 80, 83, 111, 227, 243.1, 2/244, 250; 5/482, 494, 655
See application file for complete search history.

(56) References Cited

U.S. PATENT DOCUMENTS

| | | | | | |
|---|---|---|---|---|---|
| 528,988 | A | * | 11/1894 | Rubens | 2/113 |
| 1,497,685 | A | * | 6/1924 | Hoyme | 2/67 |
| 1,548,830 | A | * | 8/1925 | Dunsworth | 2/48 |
| 1,584,853 | A | * | 5/1926 | Dern | 2/69 |
| 1,723,644 | A | * | 8/1929 | Collingbourne | 2/69.5 |
| 2,199,869 | A | * | 5/1940 | Baker et al. | 248/102 |
| 2,425,635 | A | * | 8/1947 | Nitzberg | 2/75 |
| 2,441,745 | A | * | 5/1948 | Benamy | 2/69 |
| 2,469,556 | A | * | 5/1949 | Jacobson | 2/83 |
| 2,568,544 | A | * | 9/1951 | Head | 2/46 |
| 2,635,245 | A | * | 4/1953 | Nigro | 2/80 |
| 2,735,102 | A | * | 2/1956 | Plattner | 2/80 |
| 2,743,451 | A | * | 5/1956 | Meyers | 2/83 |
| 2,814,044 | A | * | 11/1957 | Tucker | 2/80 |
| 2,922,164 | A | * | 1/1960 | Liff | 2/49.2 |
| 3,034,132 | A | * | 5/1962 | Landsberger et al. | 2/69.5 |
| 3,484,974 | A | * | 12/1969 | Culmone | 40/586 |
| 3,597,763 | A | * | 8/1971 | Bienvenu | 2/49.3 |
| 3,608,092 | A | * | 9/1971 | Tatanto | 2/49.1 |
| 4,125,903 | A | * | 11/1978 | Farrell | 2/69.5 |
| 4,172,300 | A | * | 10/1979 | Miller | 5/424 |
| 4,234,229 | A | * | 11/1980 | Arnold | 297/467 |
| 4,249,268 | A | * | 2/1981 | Berler | 2/115 |
| 4,295,230 | A | * | 10/1981 | Blodgett | 2/69.5 |

(Continued)

FOREIGN PATENT DOCUMENTS

GB 2461120 A * 12/2009

OTHER PUBLICATIONS

Taggies Kids II, Inc.—Sleep & Play Sleep & Play http://www.kidsii.com/taggies/p-400-sleep-play.aspx 2012.

*Primary Examiner* — Bobby Muromoto, Jr.
(74) *Attorney, Agent, or Firm* — Goldstein Law Offices, P.C.

(57) ABSTRACT

A fabric flap for attaching to an infant garment such that the flap is within reach of an infant at all times, so that the infant can grasp the flap in a hand, particularly when the infant flails about while crying. The flap is a comfort object that sooths and comforts the infant, replacing a security blanket or other type of lovey. With the flap, the infant can touch a cheek and a chin, but the flap cannot reach and block a nose or a mouth, removing the threat of suffocation. The infant can freely move an arm holding the flap. The flap attaches to a one-piece garment that extends over an infant torso to a crotch, the crotch of the garment selectively fastened closed. In a further embodiment, the flap attaches to a torso harness that extends from the neck to the fastened closed crotch.

15 Claims, 4 Drawing Sheets

U.S. PATENT DOCUMENTS

D269,658 S * 7/1983 Bor ..... D2/719
4,611,353 A * 9/1986 Als et al. ..... 2/69
4,710,979 A * 12/1987 Bull et al. ..... 2/48
4,723,323 A * 2/1988 Wright, Jr. ..... 2/48
4,829,601 A * 5/1989 Spanier ..... 2/49.1
4,837,864 A * 6/1989 Thill ..... 2/244
4,860,387 A * 8/1989 Williams ..... 2/244
4,884,298 A * 12/1989 Silas ..... 2/49.1
4,897,885 A * 2/1990 Lunt ..... 2/69.5
4,989,285 A * 2/1991 Troncone et al. ..... 5/482
4,993,090 A * 2/1991 Ranalli ..... 5/482
5,005,218 A * 4/1991 Ganz ..... 2/69
5,046,204 A * 9/1991 Mohler ..... 5/413 R
5,153,940 A * 10/1992 Bergquist ..... 2/80
5,222,259 A * 6/1993 Bristor ..... 2/115
5,243,724 A * 9/1993 Barnes ..... 5/482
5,244,278 A * 9/1993 Robitaille ..... 383/4
5,551,687 A * 9/1996 Krull ..... 473/573
5,641,200 A * 6/1997 Howell ..... 297/256.17
5,715,542 A * 2/1998 Reinhart, Jr. ..... 2/49.1
5,718,589 A * 2/1998 McCracken et al. ..... 434/159
5,722,094 A * 3/1998 Ruefer ..... 2/69.5
5,735,004 A * 4/1998 Wooten et al. ..... 5/502
5,802,610 A * 9/1998 Burr ..... 2/49.4
5,813,580 A * 9/1998 Fair ..... 224/160
5,887,278 A * 3/1999 Lewis et al. ..... 2/49.1
5,918,311 A * 7/1999 Lampson et al. ..... 2/49.2
5,933,886 A * 8/1999 Washington ..... 5/494
6,038,702 A * 3/2000 Knerr ..... 2/244
6,189,166 B1 * 2/2001 Braine et al. ..... 5/482
6,209,133 B1 * 4/2001 Hinshaw ..... 2/49.1
6,216,269 B1 * 4/2001 Smith et al. ..... 2/46
D448,914 S * 10/2001 Caudill ..... D2/719
6,427,265 B1 * 8/2002 Dix ..... 5/482
6,626,536 B2 * 9/2003 Mesplay ..... 351/203
6,684,422 B2 * 2/2004 LeFevre et al. ..... 5/496
6,757,922 B2 * 7/2004 Chancey ..... 5/482
6,817,033 B2 * 11/2004 Bailey ..... 2/69.5
RE38,782 E 8/2005 Dix
D510,792 S * 10/2005 Vazquez et al. ..... D2/719
7,032,247 B2 * 4/2006 Frieswick et al. ..... 2/49.1
7,269,856 B1 * 9/2007 Cannan ..... 2/49.1
7,409,726 B2 * 8/2008 Bahm et al. ..... 2/49.1
7,409,729 B2 * 8/2008 Bahm et al. ..... 2/111
D583,421 S 12/2008 Slinker
7,512,993 B1 * 4/2009 Gutierrez ..... 2/49.1
7,665,151 B1 * 2/2010 Finell ..... 2/49.1
8,137,150 B2 * 3/2012 Oestreicher ..... 446/227
2001/0047532 A1 * 12/2001 Marrero ..... 2/49.1
2005/0241042 A1 * 11/2005 Frieswick et al. ..... 2/49.1
2006/0010558 A1 * 1/2006 Prater ..... 2/111
2007/0011795 A1 * 1/2007 Davenport ..... 2/49.1
2007/0143904 A1 * 6/2007 Brown ..... 2/49.1
2007/0192923 A1 * 8/2007 Bahm et al. ..... 2/49.1
2007/0192924 A1 * 8/2007 Bahm et al. ..... 2/49.1
2008/0121191 A1 * 5/2008 Wu ..... 119/770
2008/0250541 A1 * 10/2008 Chen ..... 2/49.1
2009/0078596 A1 * 3/2009 Frump ..... 206/223
2009/0229033 A1 * 9/2009 Mertz ..... 2/69
2010/0024090 A1 * 2/2010 Finell ..... 2/49.1
2010/0095423 A1 * 4/2010 Lucas ..... 2/49.2
2011/0088133 A1 * 4/2011 Cox ..... 2/49.1

* cited by examiner

BABY SLEEP AND COMFORT AID

TECHNICAL FIELD

The present disclosure relates generally to an infant sleep aid and comfort object. More particularly, the present disclosure relates to a flap attaching to a infant garment, safely providing comfort and promoting sleep.

BACKGROUND

Infants, especially newborn infants, generally have problems with sleeping. The infant must learn during the first year of life how to self-sooth and calm down to allow sleep to come naturally. Much to the chagrin of parents and caregivers, infants require intervention and outside help from sleep-deprived adults to settle down to sleep.

Infants during the first year are also vulnerable to crib death or sudden infant death syndrome (SIDS). Generally, these tragic deaths occur without anticipation or explanation. Most often, these incidents occur at night while the parents are sleeping. It has been suspected that accidental suffocation plays a role, but it has never been confirmed as the sole causation.

Many recommendations have been made based on statistical analysis of what is most commonly found in SIDS cases. Experts tell parents to place the child in a "naked" crib; that is, they advise against using pillows, blankets, sleep positioners, bumper pads, stuffed animals, toys, or any fluffy bedding in the crib and recommend instead dressing the child warmly.

Following the "naked" crib policy means that when an infant wakes up during the night and is not hungry or uncomfortable, there is nothing available in the crib to comfort and calm the infant back to sleep. Babies and small children traditionally have used comfort objects, such as blankets, toys and stuffed animals, often referred to as a lovey, banky or blanky. In the "naked" crib, the baby has nothing to grab onto for comfort and soothing. Without any comfort object, the infant takes longer to settle back down, often waking the parent to intervene by providing rocking and other soothing actions.

Many have realized the value of having a toy or object for an infant to grab during awake periods and some have proposed adding tags or tassels to toys or clothing for the amusement of the infant. These tags and tassels are intended to stimulate rather than comfort the infant. Others have proposed blankets that selectively attach to the infant or that are filled with a substance that invokes a memory of amniotic fluid. None of these are available to the infant in the "naked" crib.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional techniques have been discussed to facilitate the present disclosure, no aspects are disclaimed and it is contemplated that the claims may encompass one or more of the conventional aspects discussed herein.

BRIEF SUMMARY

An object of an example embodiment in the present disclosure is to provide an object that an infant can reach and grasp in a hand. Accordingly, an example embodiment is a flap attaching to an infant garment, the flap having a position and a length such that the infant can reach and grasp in a hand.

Another object of an example embodiment in the present disclosure is to provide a comfort object for an infant that poses no threat of suffocation. Accordingly, an example embodiment is a flap attaching to an infant garment, the flap having a length such that an infant can touch a face on a cheek and a chin with the flap, but does not reach and block a nose or a mouth, posing no threat of suffocation.

A further object of an example embodiment in the present disclosure is to provide a flap that an infant can grasp in a hand and freely move an arm grasping the flap. Accordingly, an example embodiment is a flap attaching to an infant garment, the flap having a length such that an arm with the flap grasped in a hand, the length of the flap allows the arm to freely move from a shoulder, an elbow and a wrist.

Yet a further object of an example embodiment in the present disclosure is to provide a flap that attaches to a garment in a fixed position relative to a face of an infant. Accordingly, an example embodiment is a flap attaching to an infant garment, the garment extending over a torso of the infant from a neck to a crotch, the crotch of the garment selectively fastened in a closed position, maintaining the flap in a fixed position relative to a face of an infant.

A flap of fabric for attaching to an infant garment such that the flap is within reach of an infant, having a position and length such that the infant can reach and grasp in a hand, particularly when the infant flails about while crying. The flap has sufficient length such that the infant can touch a face on a cheek and a chin with the flap, but not of a length that reaches and blocks a nose or a mouth, posing the threat of suffocation. The length of the flap is sufficient such that the infant can freely move an arm holding the flap. The flap is within reach of the infant at all times, becoming a comfort object to sooth and comfort the infant, replacing a security blanket or other type of lovey. The flap is attached to the garment that extends over a torso to a crotch, the crotch of the garment selectively fastened in a closed position. In a further embodiment, the flap attaches to a harness that extends over the torso to the fastened closed crotch.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
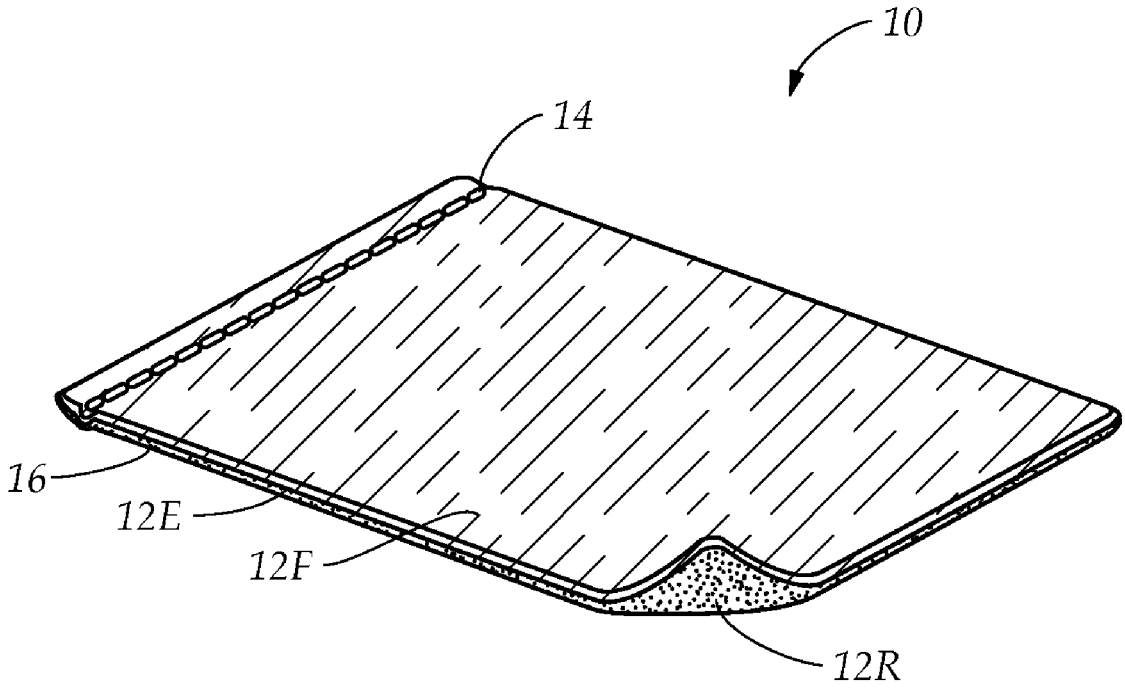
FIG. 1 is a perspective view of a comfort flap.

FIG. 1 illustrates a flap 10 for attaching to an infant garment, the flap on the garment becoming a comfort object for soothing a baby to sleep. The flap 10 fixedly and securely attaches by a top-stitch seam 14 to an infant garment, the garment extending over an infant torso, particularly under an infant crotch, the style of infant garment typically worn during sleep. The flap 10 becomes a comfort object to an infant wearing the garment when the infant is placed down to sleep in an empty crib, the empty crib having no other comfort objects available. The flap has a length, the length sufficient for an infant to grab onto and hold for comfort. The length is further sufficient for the infant to manipulate the flap up and down.

Figure 2:
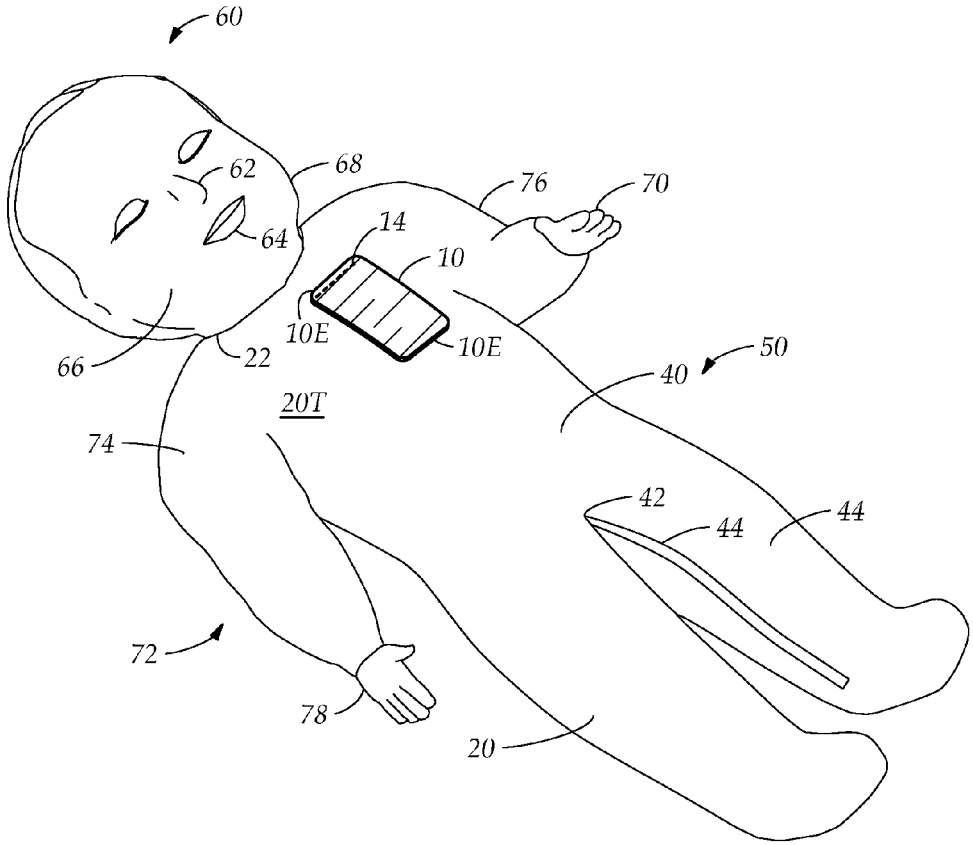
FIG. 2 is a top plan view of an infant wearing a garment having the comfort flap.

FIG. 2 illustrates the system for comforting an infant 50 when awaken during sleep. The infant 50 asleep, lying supine in an empty crib, an absence of a blanket, toy or other comfort object and a supine sleeping position currently recommended to prevent Sudden Infant Death Syndrome. The infant torso 40 is covered in the one-piece garment 20 that extends over the torso 40 having a front torso portion 20T and is selectively fastened closed under the crotch 42. The infant has a pair of legs 44 and a pair of arms 72, the arms each having a distal hand 70 connecting by a wrist 78, each arm connecting to the torso at a shoulder 74 and each arm bending at an elbow joint 76. The infant has a face 60 with a pair of cheeks 66, a nose 62 and a mouth 64.

The infant 50 is laying calmly, the flap 10 attached by the seam 14 to the torso portion 20T of the garment 20. The nose 62 and mouth 64 are unobstructed. When the infant 50 wakes up for reasons other than hunger and becomes agitated, flailing the arms 72 in search of any comfort object nearby, the empty crib provides no solace or comfort. The infant initiates a crying and flailing cycle, potentially waking up a caregiver. However, while flailing, the infant discovers the flap 10, touching the flap with the hand 70. A natural gripping reflex of the infant causes the infant hand to grab the flap. The softness of the flap provides tactile comfort to the infant.

The flap 10 is placed on the garment such that it is within reach at all times. The lower down the flap 10 is attached, the greater the length of the flap, such that the infant 50 can touch the flap to the face 60 while grasping the flap, rubbing the flap against the chin 68 and cheek 66 without obstructing the nose 62 or the mouth 64. The flap has the sufficient length such that the infant can move the arm 72 at the shoulder 74, elbow 76 or wrist 78 while grasping the flap tightly. The closed crotch 42 of the garment 20 fixes the position of the flap 10 relative to the infant face 60, such that the flap cannot move upward and extend to the nose 62 or mouth 64.

A crew-neck neckline 22 and closed crotch 42 define the front torso portion. In one embodiment, the seam 44 of the closed crotch has a pair of edges selectively fastened by a plurality of fasteners. At least one fabric flap 10 is fixedly attached to the front torso portion 20T of the garment. The flap has a pair of ends 10E, a first end attaching the flap in a fixed position by the seam 14 on the front torso portion 20T. The neckline and closed crotch that define the front torso portion restrict the movement of the front portion and the flap attached thereto. The flap has a length between the first end and the second end such that a second unfixed end 10E of the flap freely extends from the fixed position to the neckline 22, when the infant garment lies flat, the second end of the flap 10 further freely extending slightly beyond the neckline when the garment lies unevenly such as when the garment stretches during wearing by the infant as shown in FIG. 3, described hereinbelow.

Figure 3:
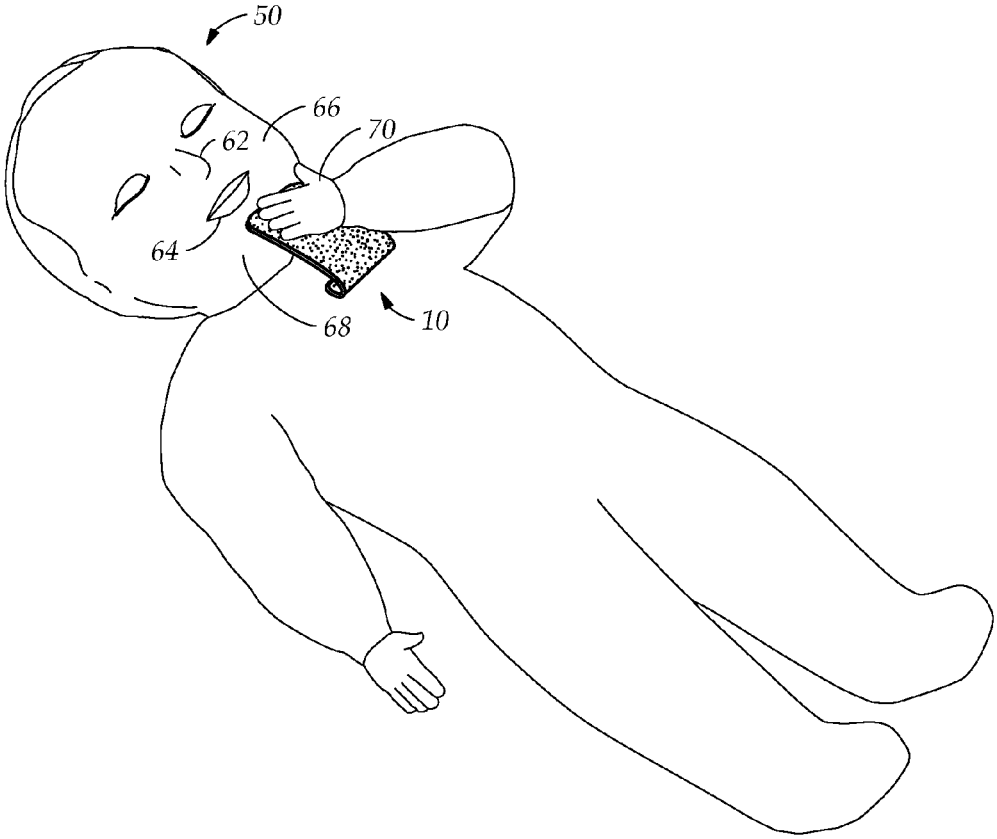
FIG. 3 is a top plan view of the infant engaging the comfort flap.

FIG. 3 shows the infant 50 holding the flap 10 in the hand 70 and selectively touching the flap 10 to the face 60 at the chin 68 and the cheek 66 without obstructing the nose 62 and mouth 64 and further without posing a threat of suffocation. The selective touching and rubbing of the flap 10 to the face 60 provides additional tactile comfort to the infant 50. The flap on the garment becomes the comfort object, replacing a security blanket or toy. When the infant grabs the flap and selectively touches and rubs the face, the flailing cycle stops and the infant returns to sleep. As the infant matures, the infant remembers the flap, seeks the flap and grabs the flap early in the waking process, thereby soothing and calming down before the flailing cycle begins.

In a further embodiment, a pair of flaps 10 is attached to the garment, one for each hand to grasp. In another embodiment the pair of flaps are attached to the garment, a first flap and a second longer flap. The longer flap attaches to the torso 20T of the garment in a position towards the legs, such that the longer flap has the length to extend to the chin and cheek without obstructing the nose or the mouth.

In the illustration, the infant is dressed in the garment 20, covering the legs 44 and the arms 72. It is understood to one of ordinary skill that the flap is attachable to any infant garment that extends over the torso and covering the legs and arms optional. The one-piece garment can be, for example, but not limited to, a pajamas, a creeper, a romper, a sleep and play "onsie" or a bodysuit.

Figure 4:
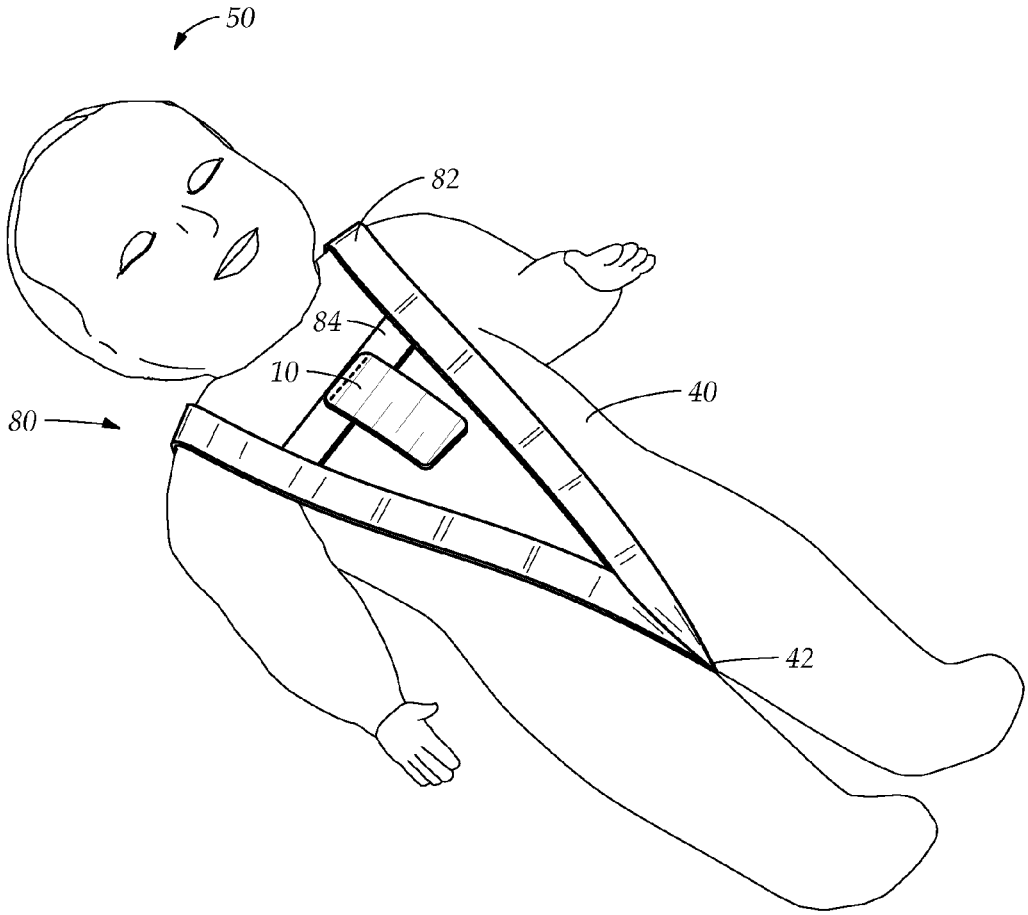
FIG. 4 is a top plan view of the infant wearing a harness having the comfort flap.

FIG. 4 shows another embodiment of the system for comforting the infant. The flap attaches to a harness 80. The harness is useful when the infant 50 is wearing a garment that is not a one-piece garment extending over the torso and fastened close at the crotch, for example, when the infant is wearing only a diaper or a two-piece garment, such as daywear. The harness 80 provides the comfort object to the infant both at sleep time and wake time. The harness 80 provides minimal covering to the torso 40 and is less likely to be soiled by a leaky diaper or spit-up. The harness is more likely to be readily available while other one-piece garments with the flap are in the laundry.

The harness 80 is the one-piece garment extending over the torso 40 and fastened closed at the crotch 42 that is placed over the diaper or the two-piece garment. At least one flap 10 with a sufficient length is placed in a position such that flap is within reach of the infant and the infant can touch the flap to the face while rubbing the flap 10 against the chin and cheek without obstructing the nose or the mouth.

The harness 60 has a pair of straps 82 that are joined together by a crosspiece 84 and further joined together at the crotch 42. At least one flap 10 is positioned on a strap 82 or the crosspiece 84. The closed crotch of the harness fixes the position of the flap relative to the infant face, such that the flap cannot move up and extend to the nose or mouth.

Referring to FIG. 1, the flap has a pair of surfaces, a first surface 12R and a second surface 12F. In one embodiment, the flap is a double-faced fabric strip, for example, such as, but not limited to, a silk double-faced satin fabric, having a pair of right faces, one on each side of the flap 10. The silk double-faced satin fabric has a soft, glossy, smooth shine on both faces of the fabric. Each right face of the double-faced satin is a surface, the pair of rights faces forming the pair of surfaces of the flap.

In another embodiment, the flap has a pair of fabric strips adhered together, each strip having at least one right face, the right face of a first strip on the first side 12R and the right side of a second strip on the second side 12F. The right face of the first side and the right face of the second side are soft, glossy and smooth. The strips are adhered together, such that the right faces of the strips are facing outwards away from each other. In a further embodiment, each strip is a different fabric, the right face of the first side, the soft, glossy, smooth fabric and the right face of the second side is a different soft fabric. In yet a further embodiment, the flap is decorated with an illustration that is pleasing to the infant.

In one embodiment, the pair of strips, the strips having edges 12E, are sewed together, the edges joined by seams, the edge seams turned invisibly inside the flap. In another embodiment, the edges of the strips are finished and the strips fixed together with an adhesive or fused together with fusible soft interfacing.

In the illustrations, only one flap is illustrated attaching to the garment. It is understood by those of ordinary skill, that the illustration is not a limitation and that a plurality of flaps are attachable to the one-piece garment.

It is understood that when an element is referred hereinabove as being "on" another element, it can be directly on the other element or intervening elements may be present therebetween. In contrast, when an element is referred to as being "directly on" another element, there are no intervening elements present.

It is further understood that, although ordinal terms, such as, "first," "second," "third," are used herein to describe various elements, components, layers and/or sections, these elements, components, layers and/or sections should not be limited by these terms. These terms are only used to distinguish one element, component, layer or section from another element, component, layer or section. Thus, "a first element," "component," "layer" or "section" discussed below could be termed a second element, component, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a flap attaching to a baby garment, safely providing comfort and promoting sleep. The disclosure is illustrated by example in the drawing figures, and throughout the written description. It should be understood that numerous variations are possible, while adhering to the inventive concept. Such variations are contemplated as being a part of the present disclosure.

What is claimed is:

1. A fabric flap for attaching to an infant garment worn by an infant, the garment having a front torso portion, a crew-neck neckline and a crotch, the neckline and crotch defining the front torso portion, comprising:

at least one strip of fabric fixedly attaching to the front torso portion of the infant garment, the strip having a pair of ends, a first end in a fixed position on the front torso portion and a second unfixed end, the strip having a length between the first end and the second end such that the second end of the strip freely extends from the fixed position to the neckline, the closed crotch and neckline of the garment fixing the position of the strip by defining the front torso portion, preventing the strip from moving upward beyond the neckline when the infant garment lies flat, the strip extending slightly beyond the neckline when the garment lies unevenly.

2. The fabric flap as described in claim 1, wherein the strip of fabric attaches to the infant garment by a sewn seam.

3. The fabric flap as described in claim 1, wherein the strip of fabric has a pair of sides each having a surface, at least one surface having a soft, smooth right face.

4. The fabric flap as described in claim 3, wherein the flap is a pair of fabric strips adhered together, forming a unitary piece, each strip having at least one soft, smooth right face, the right faces of the strips facing outwards away from each other when the fabric strips are adhered together.

5. The fabric flap as described in claim 4, wherein the pair of fabric strips is each a different fabric.

6. A tactile comfort object for soothing an infant, comprising:

a one-piece infant garment having a front torso portion, a crew-neck neckline and a selectively closed crotch, the neckline and crotch defining the front torso portion; and at least one fabric flap fixedly attaching to the infant garment, the flap having a pair of ends, a first end and a second end, the first end attaching the flap in a fixed position on the front torso portion, and the flap having a length between the first end and the second end such that the second unfixed end of the flap freely extends from the fixed position to the neckline, when the infant garment lies flat, the second end of the flap further freely extending slightly beyond the neckline when the garment lies unevenly such as when the garment stretches during wearing by the infant, the infant garment with the flap becoming a tactile comfort object when the infant selectively grasps the flap.

7. The comfort object as described in claim 6, wherein the one-piece infant garment is a pajamas, a creeper, a romper, a sleep and play "onsie" or a bodysuit.

8. The comfort object as described in claim 6, wherein the strip of fabric attaches to the infant garment by a sewn seam.

9. The comfort object as described in claim 6, wherein the strip of fabric has a pair of sides each having a surface, at least one surface having a soft, smooth right face.

10. The comfort object as described in claim 9, wherein the flap is a pair of fabric strips adhered together, forming a unitary piece, each strip having at least one right face, the right faces of the strips facing outwards away from each other when the fabric strips are adhered together.

11. The fabric flap as described in claim 10, wherein the pair of fabric strips is each a different fabric.

12. A system for providing a tactile comfort object to an infant, comprising:

a one-piece infant garment having a front torso portion, a crew-neck neckline and a selectively closed crotch, the neckline and crotch defining the front torso portion; and at least one fabric flap fixedly attaching to the infant garment, the flap having a pair of ends, a first end attaching the flap in a fixed position on the front torso portion, a second unfixed end and a length between the first end and the second end such that a second unfixed end of the flap freely extends from the fixed position to the neckline, when the infant garment is flat, the second end of the flap further freely extending slightly beyond the neckline when the garment lies unevenly such as when the garment stretches during wearing by the infant, the flap providing tactile comfort to the infant.

13. The fabric flap as described in claim 12, wherein the strip of fabric has a pair of sides each having a surface, at least one surface having a soft, smooth right face.

14. The fabric flap as described in claim 12, wherein the flap is a pair of fabric strips adhered together, each strip having at least one right face, the right faces of the strips facing outwards away from each other when the fabric strips are adhered together.

15. The fabric flap as described in claim 12, wherein the pair of fabric strips is each a different fabric.

* * * * *